United States Patent [19]

Pinkerton

[11] Patent Number: 4,941,809

[45] Date of Patent: Jul. 17, 1990

[54] VALVELESS POSITIVE DISPLACEMENT METERING PUMP

[76] Inventor: Harry E. Pinkerton, 1 Bridle Path La., Mill Neck, N.Y. 11765

[21] Appl. No.: 829,398

[22] Filed: Feb. 13, 1986

[51] Int. Cl.[5] ..... F04B 7/06

[52] U.S. Cl. ..... 417/500; 92/13

[58] Field of Search ..... 417/500, 492; 92/13, 92/13.3

[56] References Cited

U.S. PATENT DOCUMENTS 4,575,317 3/1986 Lindner ..... 417/500

OTHER PUBLICATIONS

"Instructions FMI Lab Pump Jr Model RH", Fluid Metering Inc., Oyster Bay, N.Y., Jun. 1981.

*Primary Examiner*—Leonard E. Smith

*Attorney, Agent, or Firm*—Hoffmann & Baron

[57] ABSTRACT

A valveless, variable displacement, reversible, fixed dead volume metering pump formed with a cylinder having ports through which to pump fluid. A rotatable piston is in the cylinder with a duct thereon communicable with the ports to transfer fluid to and from the cylinder. A drive coupling is provided for the piston. The piston reciprocates in the cylinder while rotating in a timed relation with respect to the ports and the timed relationship is reversible. The relative angularity between the axis of the piston and the axis of the drive coupling is reversible to obtain reversal of fluid flow with the degree of relative angularity determining the volume of fluid being pumped. A substantially constant dead-volume is maintained throughout the range of relative angularity between the axes through the use of a pair of floating swivel axes with a cam to restrict one or both of the axes and free the other depending upon direction of relative angular movement of the axis of the piston with respect to the axis of the drive coupling.

9 Claims, 2 Drawing Sheets

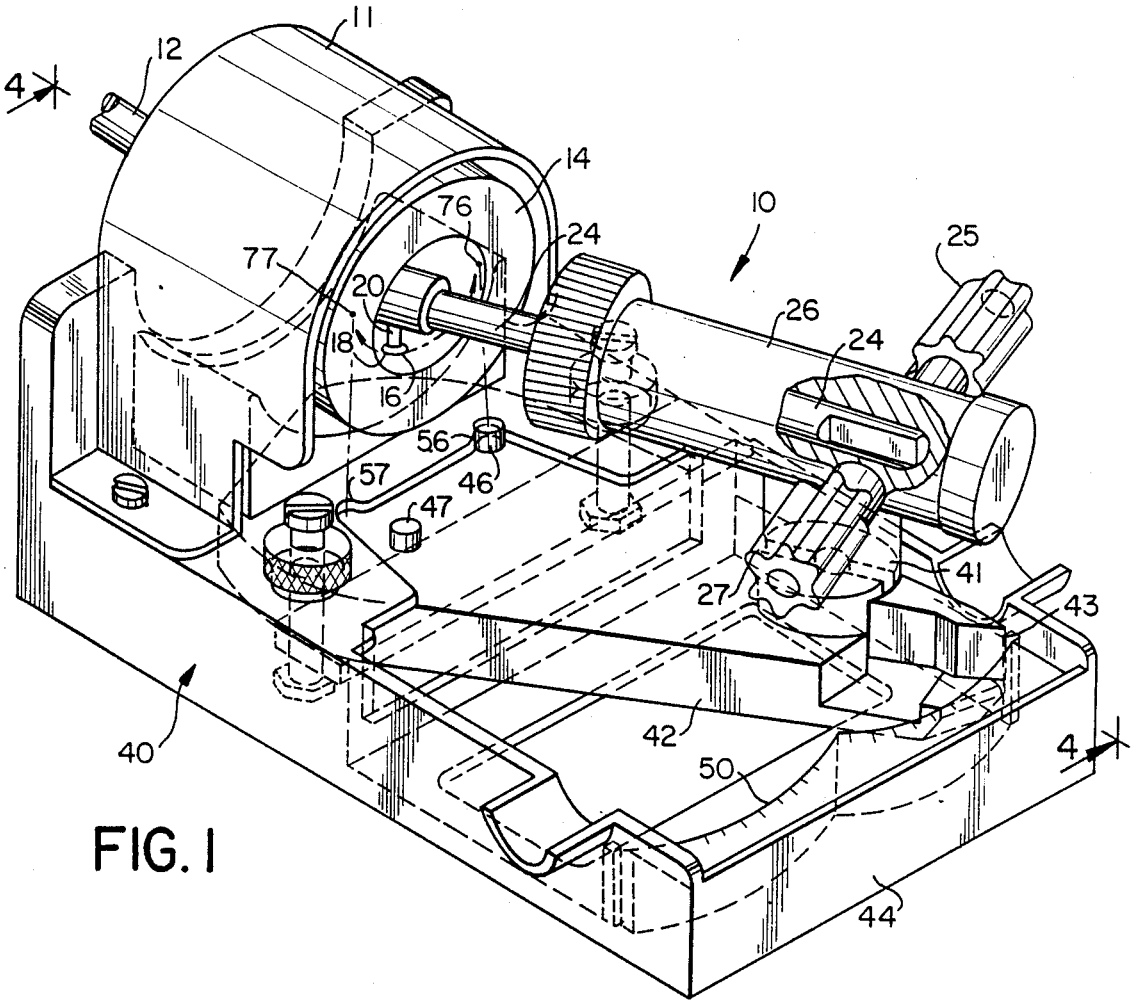
FIG. 1
FIG. 2
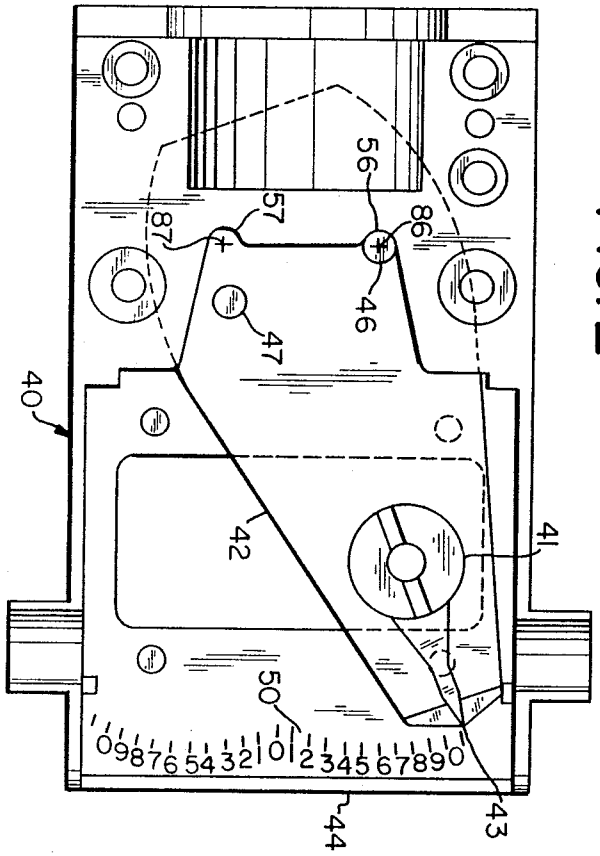

VALVELESS POSITIVE DISPLACEMENT METERING PUMP

BACKGROUND OF THE INVENTION

The present invention relates to the art of valveless positive displacement piston, metering pumps, and, in particular, to improvements which significantly enhance the accuracy of fluid delivery over the entire range of operation of such pumps It has been known in the art of valveless positive displacement piston pumps to provide a reversible pumping function and controllable variable displacement by simple variation of the angle between two segments of the pump drive-axis. For example, in U.S. Pat. No. 3,168,872 and U.S. Pat. No. 4,008,003, both to Pinkerton, the contents of which are incorporated herein by reference, a valveless, variable, reversible pump is disclosed including a ducted piston which reciprocates and rotates synchronously in a bi-ported cylinder which is closed at one end to form a cylinder head chamber. The piston duct is arranged in the piston to provide a fluid transfer conduit in combination with the wall of the cylinder which is alternately in fluid communication with each of the ports such that one port is in communication with the cylinder head chamber on the down stroke of the piston and the other port is in communication with the cylinder head chamber on the up stroke. Reversal of the duct relationship to the ports results in reversal in direction of fluid flow.

In a typical pump of this type, to actuate the piston and effect the appropriate pump action, the piston assembly is coupled with the output of a drive shaft through an off-axis yoke assembly. The piston includes at its outer end a laterally extending arm which is slidably mounted in a spherical bearing member of the yoke assembly, whereby a single point universal joint is provided. The biported cylinder, which receives the piston, is mounted for articulation around a single central axis which is perpendicular to the axis of rotation of the yoke assembly. Thus when the axis of rotation of the yoke assembly (the drive axis) and that of the piston are substantially coaxial, the piston does not reciprocate in the cylinder during rotation of the yoke, and no pumping action takes place. However, when the cylinder axis - and thus the piston axis—is articulated (relative to the axis of the yoke) at the perpendicular axis, reciprocation occurs. The direction of deflection (to right or left) determines the direction of fluid feed through the pump chamber and the degree of angular movement determines the amplitude of piston stroke and, consequently, its displacement for each rotation of the drive motor shaft.

Inasmuch as diameter of the cylinder, the length of the piston stroke, and the stroke repetition rate are all determinable, the rate of fluid flow should, likewise, be dependably determinable. Surprisingly, however, dependable fluid flow control is not always possible, since unpredictable fluid inconsistencies can occur as a result of, for example, entrained or dissolved gases in the liquid stream which can grossly distort effective displacement values. This is particularly true in the low-flow portion of the flow rate range of such pumps because at low-flow settings they exhibit larger cylinder chamber dead-volume (a prime source of random bubbles) than at high flow settings. It will be seen therefore that since a large chamber dead-volume (low flow rate) poses a greater chance of bubbles lodging and flexing in the cylinder head chamber than a small volume (large flow rate), pumps of this type are often unsuitable for applications wherein accurate fluid delivery in the lower 15% of the possible flow rate range is required.

In view of the increasing demand for accurately adjustable rate flow pumps and the broadening scope of applications for them, a need exists to provide pumps that can be readily utilized for fluid delivery over an increased portion of the possible range of adjustment. Thus, it is an object of the present invention to provide a controllably variable and reversible positive displacement metering pump with a chamber dead-volume that may be minimized and remain constant in volume through the entire adjustment range of the pump whereby the accuracy of fluid delivery is significantly enhanced, even in the low volume portion of its operating range.

It is a further object of the invention to provide enhanced fluid delivery accuracy throughout the operating range of such pumps without modification of the basic pump and drive linkage design.

Another object of the present invention is to provide increased accuracy of fluid delivery over the full range of operation of such pumps utilizing the same method of determining direction of flow and adjustment of fluid delivery.

Other and further objects and advantages will become apparent from the following disclosure which is to be taken in conjunction with the accompanying drawings illustrating preferred as well as exemplary embodiments of the invention.

BRIEF DESCRIPTION OF THE INVENTION

The present invention is an improved valveless, variable displacement, reversible action fluid pump which includes a cylinder having port means for fluid transit to and from it and a rotatable piston with an axis and duct means communicable with the port means for transfer of fluid into and out of the cylinder. The pump further includes a drive means connected to the piston which also has an axis and means for causing the piston to reciprocate in the cylinder while rotating in a timed relation with respect to the port means and means for reversing the timed relationship without reversing the direction of rotation. The reversing means is operable to reverse the direction of angularity between the axes to obtain fluid flow reversal; the degree of relative angularity determines the volume of fluid being pumped. Finally, the improved pump of the present invention includes means whereby the piston returns, each stroke, to a substantially constant dead-volume point in the cylinder throughout the range of relative angularity and direction between the axes.

As a result of this improved control of dead-volume, the accuracy of the fluid delivery throughout the entire range of fluid flow rate adjustment is increased.

BRIEF DESCRIPTION OF THE DRAWINGS

FIG. 1 is a perspective view of a preferred embodiment of the improved positive displacement pump of the present invention with a partial section view showing the piston in the cylinder assembly;

FIG. 2 is a plan view of the swivel platform of FIG. 1 with the piston cylinder assembly removed therefrom;

DETAILED DESCRIPTION

Figure 3:
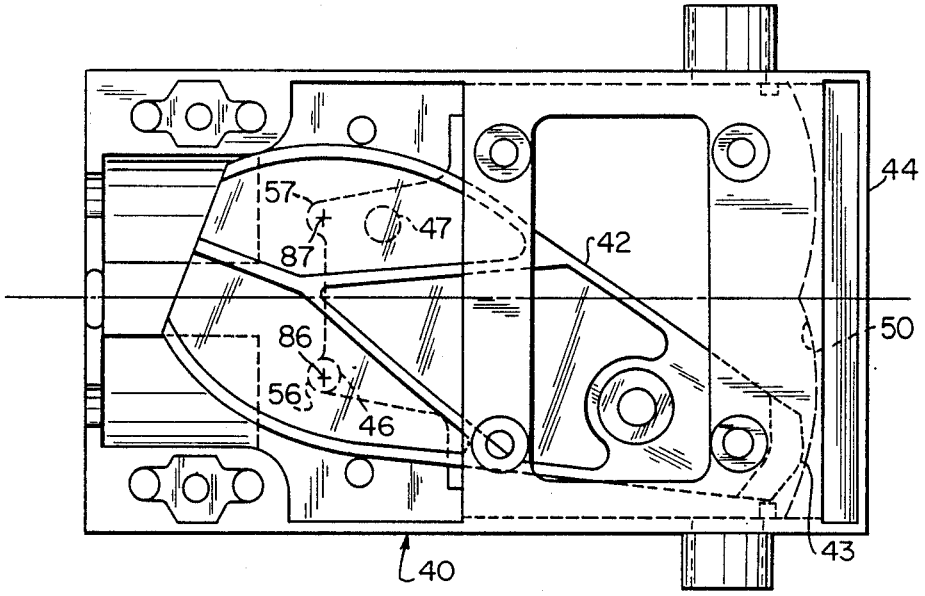
FIG. 3 is a bottom view of the platform shown in FIG. 2.
Figure 4:
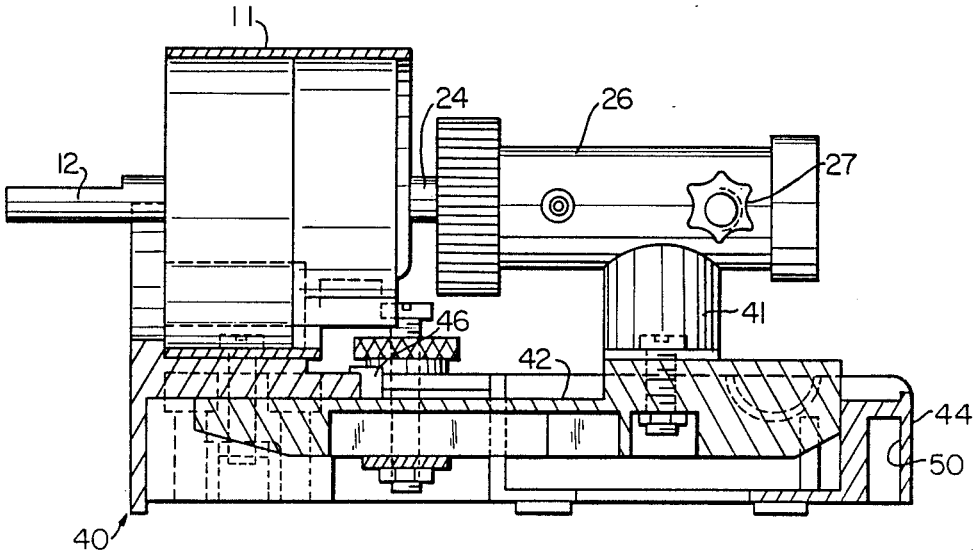
FIG. 4 is a side-elevational view in section of the entire assembly in accordance with the one embodiment of the present invention.

Referring to FIG. 1, a positive displacement piston/-cylinder assembly 10 is shown mounted on a unique support assembly 40 of the present invention. A rotary drive shaft 12 is secured to a yoke 14. The yoke 14 is mounted in a bearing support in housing 11.

Formed in a yoke 14 is a socket 16 of a universal ball and socket bearing in which ball 18 is slidably mounted on an arm 20 projecting laterally from, and secured to, a piston 24 which is reciprocably and rotatably mounted in a cylinder 26. The circular path of the single point universal coupling 16/18 is the power path which drives the rotation and stroke action of piston 24.

As shown and described herein, the cylinder 26 is provided with two ports 25 and 27 which operate as inlet or outlet ports depending on the direction of flow selected by angular displacement of swivel platform 42.

The cylinder 26 is mounted on swivel platform 42 by means of mounting stud 41 which permits swivel movement of the cylinder 26 angularly with respect to support frame 44 both clockwise and counterclockwise. When piston 24, cylinder 26 and yoke 14 are substantially coaxially aligned with each other, i.e., when platform 42 is oriented at the middle of the support frame 44, the piston will have no stroke nor will it reciprocate upon rotation of yoke 14. Thus, no pumping action takes place in this position.

As is understood with regard to positive displacement pumps of this nature, when the cylinder 26 is pivoted in a counterclockwise direction, as shown in FIG. 1, the piston will be oriented and operate to pump the liquid out of port 27 so that the port 27 becomes the outlet port while the port 25 serves as an inlet port. The greater the angular displacement of the cylinder 26 away from the center of the support frame 44, the greater the displacement of the piston in the cylinder 26 which causes a higher rate of fluid flow. As the cylinder 26 is brought closer to the middle of the support, the displacement of the pumping piston becomes smaller within the cylinder 26, resulting in a lower volume of fluid flow. When the cylinder 26 is pivoted in a clockwise direction from the middle position on the support frame 44, the direction of the fluid flow will reverse resulting in port 25 becoming the outlet port and port 27 becoming the inlet port. Once again the magnitude of the angular displacement of the cylinder 26 from the middle of the support frame 44 will determine the amplitude of piston stroke, and, consequently, the rate of fluid flow.

In the present invention two parallel control axes are provided to cause the cylinder dead-volume to be constant throughout the entire range of stroke length adjustment. These two axes are located tangent to and in the plane of the circular path travelled by the connecting universal coupling provided by socket 16 and ball 18. Thus, when the piston/cylinder assembly is angularly deflected counterclockwise from the central position on support frame 44, the control axis of such deflection is essentially tangent at point 86 of FIG. 2 to the right hand extremity of the circular path (at 3 o'clock) while the control axis for angular displacement clockwise is tangent at point 87 of FIG. 2 to the left hand extremity of the circular path (at 9 o'clock) of universal coupling 16/18.

In order to provide these dual axes of angular deflection, the cylinder 26 is mounted on a swivelling platform 42 having bearing means in the form of two perpendicular posts 46 and 47 which act cooperatively with an indicator edge 43 on platform 42 as it bears against cam surface 50, and with bearing sockets 56 and 57 formed in the support frame 44 so that dual pivot axes are established to control deflection of platform 42. One of the bearing posts 46/47 is used for each direction of angular deflection of the piston and cylinder with respect to the pump drive axis. The center lines 86 and 87 of the posts 46 and 47 as they fit into sockets 56 and 57 are tangent to points 76, 77, respectively.

Thus, the cam surface 50 is provided to permit freedom to only one bearing post to float at a time, and to provide directional restraints to permit such float in only one direction for each bearing post. As a result of this unique arrangement, when both axes are restrained simultaneously, there is no angular deflection nor piston reciprocation, and thus, no fluid being pumped.

As the piston axis is deflected to the right, for example, as shown in FIG. 1, the left post 47 floats away from its restraint while the right post 46 is cammed against its restraint socket 56 thereby establishing the center line 86 of post 46 as the control axis. Since each control axis is tangent to the circumferential path of travel of coupling 16/18 at the point in each pump cycle corresponding to the minimum volume point of the piston in the cylinder, it will be understood that the same minimum volume point will be reached each cycle regardless of the angle of deflection imposed upon the piston. Thus, a constant minimal dead-volume can be maintained throughout the operating range of the pump system, enhancing both accuracy and control.

While there have been described what are presently believed to be the preferred embodiments of the invention, those skilled in the art will realize that other and further changes and modifications can be made to the invention without departing from the true spirit thereof, and all such changes and modifications as fall within the true scope of the invention are claimed herein.

I claim:

1. A valveless, variable displacement, fixed head volume, piston metering pump comprising:
   - a cylinder having port means to direct fluid and a head chamber to contain fluid;
   - a rotatable piston in said cylinder, said piston having an axis;
   - duct means on said piston communicable with said port means for transfer of said fluid to and from the cylinder head chamber;
   - drive means for said piston, said drive means having an axis, and means for causing said piston to reciprocate in said cylinder to and from a fixed dead volume point while rotating in a timed relation with respect to said port means; and
   - means for reversing said timed relationship through reversal of relative angularity between said axes to obtain fluid flow reversal at flow rates determined by the degree of relative angularity of the two axes.

2. The invention in accordance with claim 1 wherein pivot means is provided to permit adjustment of the relative angle between said axes to control the fluid flow rate as desired.

3. The invention in accordance with claim 2 wherein said pivot means includes a pair of coordinated floating control axes with each one being for an opposite direction of relative angular movement.

4. The invention in accordance with claim 3 wherein the two control axes are located oppositely tangent to the circular path travelled by said drive means.

5. The invention in accordance with claim 4 wherein cam means are provided to restrict floating of one or more of said control axes, said cam means being positioned so that when both control axes are restrained from floating, angular deflection is 0 and there is no piston reciprocation nor pumping of fluid, shifting of the relative angularity between said axes in one direction permits one of said control axes to float away from its active position by said cam means into an inactive position while the other of said control axes is cammed into the active position to thereby becoming the active control axis, and as the relative angularity of the axes is changed in the opposite direction, the other of said control axes floats away from its active position into an inactive position while the one swivel axes is cammed into the active position thereby becoming the active control axis.

6. The invention in accordance with claim 5 wherein the cam means includes a platform including a pair of spaced posts adapted to each removably engage a pair of corresponding spaced sockets in the fixed support for said pump, each of said active control axes being located through a post when the post is engaged with said socket and a cam surface engagable by the platform to direct the posts to selectively engage the sockets.

7. The invention in accordance with claim 6 wherein swivelling of the platform in one direction will cause the surface on said support surrounding said one socket to engage and restrain said mating post while the other post is freely displaced from engagement with the surface of said support surrounding the other socket.

8. The invention in accordance with claim 5 wherein the control axes are arranged so that the active control axis intersects and is tangent to the piston coupling path at one point in each pump cycle and, at that point the minimal volume point will be reached each cycle regardless of the angle of deflection imposed upon the piston thereby maintaining a substantially constant minimal dead volume throughout the operating range of pump and enhancing both accuracy and control.

9. The invention in accordance with claim 1 wherein actuator means is provided for reciprocating said piston upon operation of said drive means whereby fluid is drawn into said cylinder head chamber through said duct means from one of said ports and then out of said cylinder head chamber through said duct means and out through the other of said ports, said actuator means including pivot means for changing the angular relationship between the axes of the piston and said drive means to change the stroke length of the piston and vary the fluid flow, said pivot means including a platform pivotally supporting said cylinder, such that said cylinder is pivotable about one of a pair of spaced control axes depending upon the chosen direction of angular displacement, each of the two control axes when active being located oppositely tangent to the circular path travelled by said drive means and cam means engageable with respect to at least one of said control axes so as to permit float freedom of only one control axes at a time and including directional restraints to permit float in only one direction for each control axes and to restrain both control axes simultaneously when the relative angular deflection is zero and there is no piston reciprocation and no pumping or fluid, the cam means being responsive to deflection of the piston axis relative to the drive axis to permit floating of one control axis and fixing of the other depending upon the direction of deflection.

* * * * *